US005603303A

United States Patent [19]

Okajima et al.

[11] Patent Number: 5,603,303

[45] Date of Patent: Feb. 18, 1997

[54] HIGH PRESSURE FUEL SUPPLY PUMP

[75] Inventors: Masahiro Okajima, Anjo; Kazuo Yamamoto, Nagoya; Hiroshi Inoue, Chiryu; Masaaki Katou, Kariya; Hiroyuki Kano, Nagoya, all of Japan

[73] Assignee: Nippondenso Co., Ltd., Kariya, Japan

[21] Appl. No.: 533,913

[22] Filed: Sep. 26, 1995

Related U.S. Application Data

[63] Continuation of Ser. No. 429,564, Apr. 27, 1995, abandoned.

[30] Foreign Application Priority Data

Apr. 28, 1994 [JP] Japan ..... 6-91106
Mar. 1, 1995 [JP] Japan ..... 7-41545

[51] Int. Cl.[6] ..... F02M 37/04

[52] U.S. Cl. ..... 123/508; 123/509

[58] Field of Search ..... 123/508–9, 456, 123/506

[56] References Cited

U.S. PATENT DOCUMENTS

| | | | |
|---|---|---|---|
| 4,412,513 | 11/1983 | Obermayer et al. | 123/509 |
| 4,412,519 | 11/1983 | Hoch et al. | 123/449 |
| 4,522,182 | 6/1985 | Mowbray | 123/509 |
| 4,739,733 | 4/1988 | Hartmann et al. | 123/508 |
| 4,836,171 | 6/1989 | Melde-Tuczai et al. | 123/508 |
| 4,838,232 | 6/1989 | Wich | 123/506 |
| 5,083,544 | 1/1992 | Brighigna | 123/508 |
| 5,094,216 | 3/1992 | Miyaki et al. | 123/506 |
| 5,193,510 | 3/1993 | Straubel | 123/509 |
| 5,357,944 | 10/1994 | Rathmayr | 123/509 |
| 5,390,647 | 2/1995 | Schechter | 123/532 |
| 5,398,658 | 3/1995 | Mesimaki | 123/509 |
| 5,404,855 | 4/1995 | Yen et al. | 123/456 |
| 5,479,903 | 1/1996 | Werner et al. | 123/509 |

FOREIGN PATENT DOCUMENTS

| | | |
|---|---|---|
| 307947 | 3/1989 | European Pat. Off. . |
| 543301 | 5/1993 | European Pat. Off. . |
| 307947 | 11/1993 | European Pat. Off. . |
| 60-27763 | 2/1985 | Japan . |
| 5-288073 | 11/1993 | Japan . |
| 1048969 | 11/1966 | United Kingdom . |
| 2070685 | 9/1981 | United Kingdom . |
| 2150229 | 6/1985 | United Kingdom . |
| 2195708 | 4/1988 | United Kingdom . |
| 2265943 | 10/1993 | United Kingdom . |

*Primary Examiner*—Thomas N. Moulis
*Attorney, Agent, or Firm*—Cushman, Darby & Cushman IP Group of Pillsbury Madison & Sutro LLP

[57] ABSTRACT

A high pressure fuel supply pump comprises a cylinder, the upper part of which is exposed to the outside of a head cover that is a part of the engine housing, and is fixed to the head cover by means of bolts, not shown. The remaining portion of the high pressure fuel supply pump is received in an accommodation hole of the head cover. A pump cam 111 is mounted to a valve camshaft for driving a suction/exhaust valve and drives the high pressure fuel supply pump. The use of an exclusive shaft for pump driving only, a bearing member therefor, and the like is rendered unnecessary, which enables a reduction in the number of parts employed. Further, since the timing with which the pressurized fuel is discharged is controlled through the operation of a solenoid valve, the precision with which fuel injection is controlled is improved.

16 Claims, 20 Drawing Sheets

HIGH PRESSURE FUEL SUPPLY PUMP

This is a continuation of application Ser. No. 08/429,564, filed Apr. 27, 1995, now abandoned.

CROSS REFERENCE TO RELATED APPLICATION

This application is based upon and claims priority from Japanese Patent Application No. Hei 6-91106 filed Apr. 28, 1994 and Japanese Patent Application No. Hei 7-41545 filed Mar. 1, 1995, with the contents of each document being incorporated herein by reference.

BACKGROUND OF THE INVENTION

1. Field of the Invention

The present invention relates to a high pressure fuel supply pump which is used in an internal combustion engine ("internal combustion engine" is hereinafter referred to simply as "engine").

2. Description of the Related Art

A fuel supply system for an engine that uses a conventional high pressure fuel supply pump is illustrated in FIG. 22. Within a fuel tank 201 there is accommodated a fuel pump 202 by which fuel is pressurized to several hundred KPa and forcibly supplied to an intake port 204 of a fuel filter 203. A discharge port 205 of the fuel filter 203 is connected to an intake port 207 of a high pressure fuel supply pump 206. The drive force produced by the reciprocating movement of a piston 211 is transmitted to a camshaft 210 by a connection mechanism composed of a connecting rod 212, a crank shaft 213, and a belt 214, thereby rotating the camshaft 210 of the high pressure fuel supply pump 206. As shown in FIGS. 20 and 21, a pump-driving cam 224 accommodated within a housing 223 of the high pressure fuel supply pump 206 and adapted to rotate integrally with the camshaft 210 causes the reciprocating movement of a plunger 225 of the supply pump 206. The fuel taken in from the intake port 207 is pressurized by the high pressure fuel supply pump 206 to a high pressure level of several MPa to several tens of MPa and is then discharged through a delivery valve 226 to a common rail 209 via a discharge port 208. The high pressure fuel that has accumulated in the common rail 209 is supplied through a branch passage 215 to an injector 217 provided for each air cylinder. Then, the high pressure fuel is injected from the injector 217 directly to a combustion chamber 216 within the air cylinder.

The unnecessary low pressure fuel that is outputted from a bypass discharge port 218 of the high pressure fuel supply pump 206 is returned to the fuel tank 201 through a return passageway 219. A pressure sensor 220 for sensing the pressure of the fuel inside the common rail 209 is disposed thereon, whereby a pressure signal obtained as a result of the detection performed by the pressure sensor 220 is inputted to an electronic control unit 221. The electronic control unit 221 controls the energizing timing of a solenoid valve 222 so that the fuel injection pressure is of optimum level, in correspondence with the pressure signal sensed by the pressure sensor 220 and the operating conditions of the engine such as, for example, the number of engine revolutions, the engine load, and the like, thereby controlling the amount of fuel discharged into the common rail 209. Further, the electronic control unit 221 outputs a control signal to the injector 217 in order to control the fuel injection timing and injection period in accordance with the operating conditions of the engine such as, for example, the number of engine revolutions, the engine load, etc.

However, since in the case of the above-mentioned conventional high pressure fuel supply pump 206, the camshaft 210 and the pump-driving pump cam 224 are built into the housing 223, the high pressure fuel supply pump 206 increases in size and weight due to the existence of the pump cam 224, part of the housing 223 covering this cam 224, and members such as, for example, the bearing of the pump cam 224, oil seal, etc., not shown. Further, since not only does the number of parts employed increase but the housing 223, camshaft 210, and parts associated therewith must necessarily be fabricated with high precision, the problem exists that there is an increase not only in the number of manufacturing steps but the manufacturing cost as well. Furthermore, on the engine side, it is necessary to provide a pump-fixing flange and a pump-fixing stay, thereby giving rise to the problem that the number of fabrication steps increases.

In order to solve the above-mentioned problems, a camshaftless pump for diesel engines is adapted for use in agricultural machinery. However, although this camshaftless pump for diesel engines is small, since the fuel injection timing and fuel amount are controlled by mechanical control based on the use of a fuel reed formed with respect to the plunger, the controllable range thereof is limited. Further, in the case of a multi-cylinder pump, since the same control is simultaneously mechanically performed with respect to all air cylinders by a built-in control rack, the problems exist that (1) separate control cannot be performed with respect to each air cylinder and that (2) the degree of freedom with which the loading space may be utilized is small because it is necessary to load the pump in one place.

SUMMARY OF THE INVENTION

The present invention was conceived in order to solve the above-mentioned problem, the object thereof being to provide a high pressure fuel supply pump which is compact and in which the fuel-discharging timing can be controlled with high precision.

In one preferred mode of the present invention, a high pressure fuel supply pump connected to a valve camshaft of an internal combustion engine having a housing at which an accommodation hole is formed, said fuel pump disposed in the accommodation hole, has a plunger moving reciprocally; a first supporting member having an intake passage and a discharge passage for fuel, and having an inner wall forming a slide hole in which the plunger is reciprocally and slidably supported; a pump cam driving the plunger to enable reciprocal movement; an urging means for urging the plunger toward the side of the pump cam; and a solenoid valve provided at one end of the slide hole for determining discharge timing of the fuel pressurized by the reciprocating movement of the plunger.

In other preferred mode of the present invention, a high pressure fuel supply pump further has an end face of the plunger, the inner wall of the first supporting member, and an end face of the solenoid valve, the fuel is introduced from the intake passage into the fuel pressurization chamber and pressurized by the reciprocating movement of the plunger.

The high pressure fuel supply pump is accommodated in the housing of the engine and the plunger is driven by the pump cam mounted on the valve camshaft, whereby a camshaft exclusively used for driving the high pressure fuel supply pump becomes unnecessary. This results in the advantages that the mass of the portion of the high pressure fuel supply pump that is exposed to the exterior of the engine housing is reduced, thereby increasing the degree of freedom with which the loading space thereof can be utilized. In addition, the number of the parts used is decreased and consequently, as a result of the high pressure fuel supply pump being easily fabricated, the number of manufacturing process steps decreases and the manufacturing cost can be advantageously reduced. Furthermore, since the fuel discharge timing is controlled by a solenoid valve, fuel injection can be controlled with high precision.

DETAILED DESCRIPTION OF THE PRESENTLY PREFERRED EXEMPLARY EMBODIMENTS

Embodiments of the present invention will now be described with reference to the drawings.

First Embodiment

Figure 1:
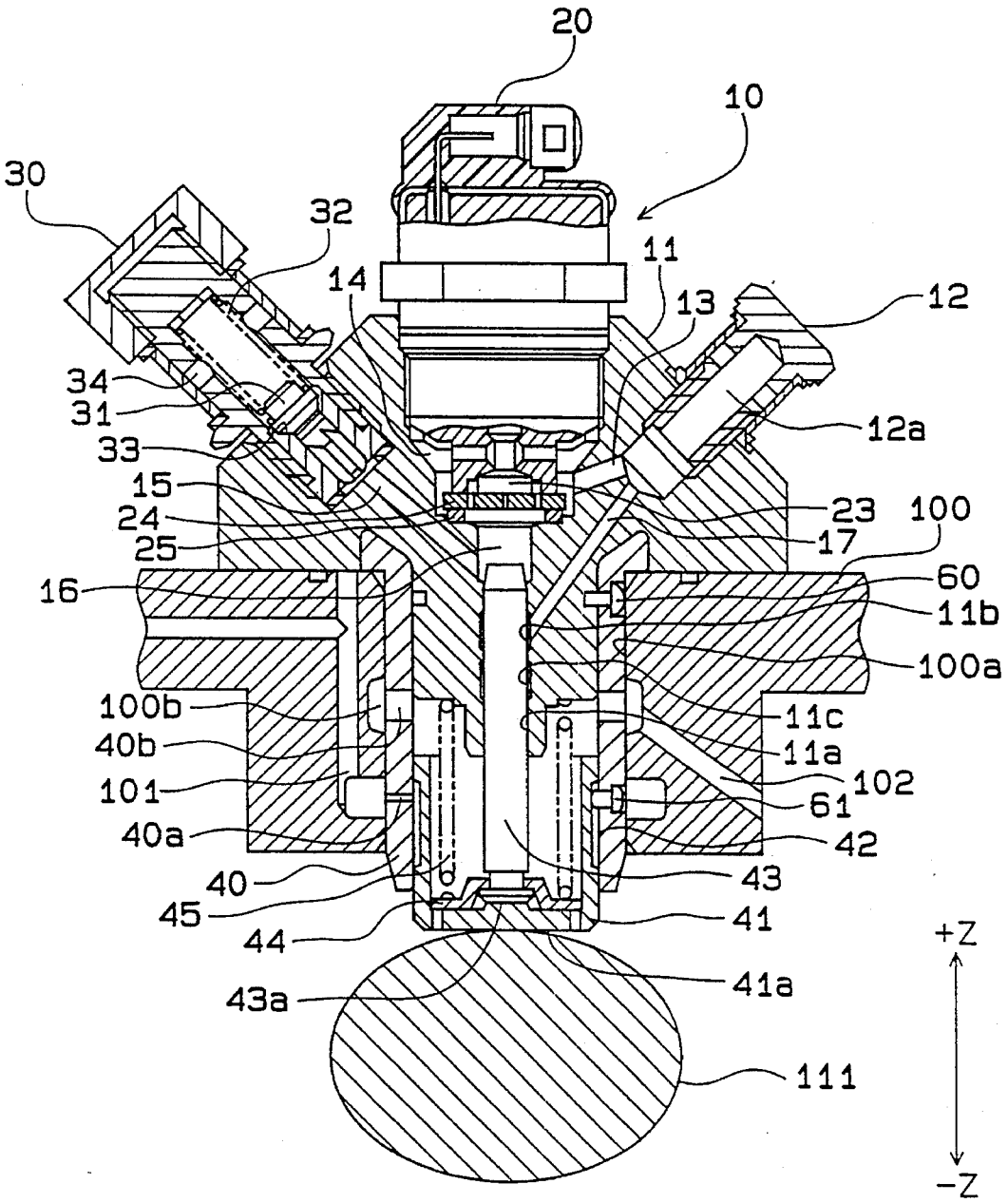
FIG. 1 is a sectional view showing a high pressure fuel supply pump according to a first embodiment of the present invention and taken along the line I—I of FIG. 2.
Figure 2:
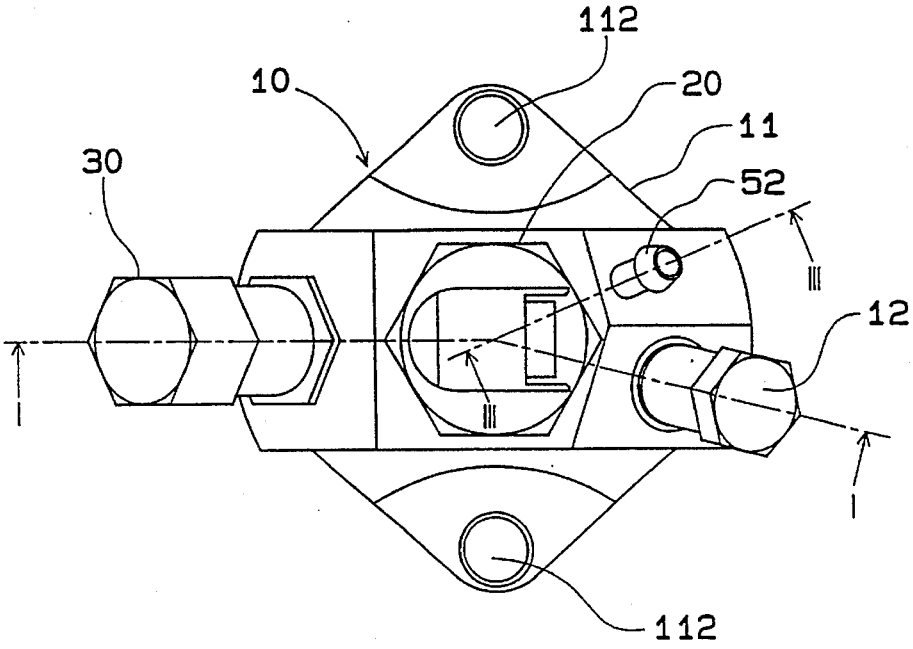
FIG. 2 is a plan view showing the high pressure fuel supply pump according to the first embodiment of the present invention.
Figure 3:
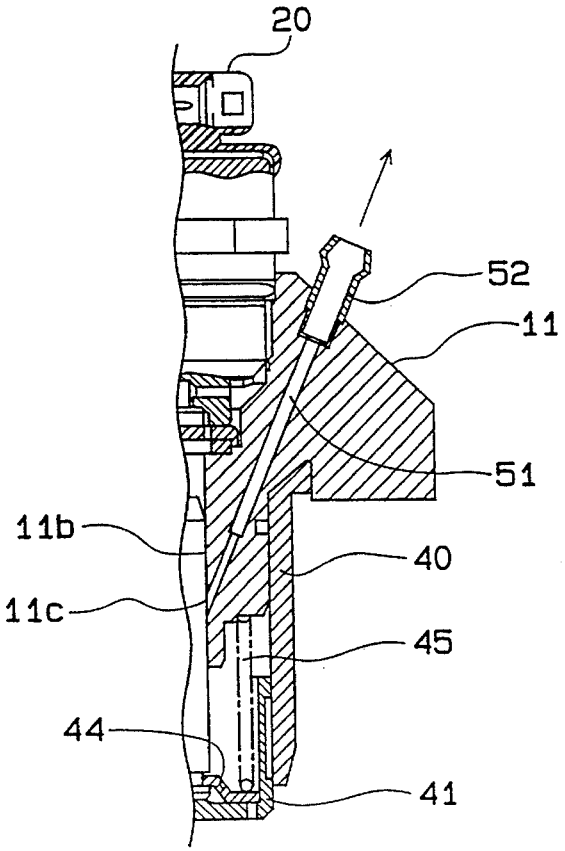
FIG. 3 is a sectional view taken along the line III—III of FIG. 2.

A high pressure fuel supply pump according to a first embodiment of the present invention is illustrated in FIGS. 1 through 3.

As shown in FIG. 1, a high pressure fuel supply pump 10 comprises a cylinder 11 provided therein with an intake port 12 formed with an intake passage 12*a*, a solenoid valve 20, and a delivery valve 30. An upper portion of the cylinder 11 is exposed to the exterior of a head cover 100 composing part of an engine housing and, in this condition, is secured to a head cover 100 by bolts 112 shown in FIG. 2. The remaining portion of the high pressure fuel supply pump 10 which is accommodated within the head cover 100 is enclosed by a tappet guide 40 and, in this condition, is accommodated within an accommodation hole 100*a* of the head cover 100. Although the tappet guide 40 is secured to the cylinder 11 by means of screws 60, according to the present invention it is possible to use pins in place of the screws 60. A pump cam 111 is mounted on a valve camshaft, not shown, that opens and closes a suction/exhaust valve, also not shown, thereby driving the high pressure fuel supply pump 10.

An inner wall surface 11*a* of the cylinder 11 which supports a plunger 43 described later so as to permit reciprocal movement thereof is formed with annular fuel reservoirs 11*b* and 11*c*. The fuel reservoir 11*b* communicates with the intake passage 12*a* via a return passageway 17 while, on the other hand, the fuel reservoir 11*c* communicates with a return passageway 51 as shown in FIG. 3.

As shown in FIG. 1, the intake port 12 is formed with the intake passageway 12*a* therein and fuel is supplied thereto from a fuel pump, not shown. The intake passage 12*a* communicates with a fuel passageway 13 and also communicates with the fuel reservoir 11*b* via the return passageway 17.

The solenoid valve 20 is orthogonally inserted downward into the cylinder 11. A valve body 22 formed with a fuel supply passage is inserted and placed within the solenoid valve 20. A valve element 23 is disposed on the valve body 2 so that it can contact with and separate from a valve seat 21. The (–) Z-axial end face (this means an end face of a minus Z-axial direction, and so forth) of the valve body 22 is in plane-contact with a plate 24, the (–) Z-axial end face of the plate 24 is in plane-contact with a washer 25, and the (–) Z-axial end face of the washer 25 is in plane-contact with the cylinder 11. The inner wall surface of the cylinder 11 which surrounds the solenoid valve 20 is formed with an annular fuel gallery 14. This fuel gallery 14 communicates with the fuel passageway 13 and a communication passageway 26.

The delivery valve 30 is secured to the cylinder 11 by screw connection and a discharge valve element 31 is urged toward a valve seat 33 by a compression coil spring 32. When the pressure within a fuel pressurization chamber 16 exceeds a specified level, the discharge valve element 31 is raised against the urging force of the compression coil spring 32, whereby a discharge passageway 15 communicates with a discharge port 34. The delivery valve 30 is connected to a common rail, not shown, by way of a fuel steel pipe, also not shown.

A tappet 41 is formed in the shape of a cylinder with a bottom and the bottom surface 41*a* thereof is in contact with the pump cam 111. The tappet 41 is slidably supported by an inner wall surface of the tappet guide 40. A cylindrical oil reservoir 42 is formed between the inner wall surface of the tappet guide 40 and an outer wall surface of the tappet 41. To this oil reservoir 42 is supplied lubricating oil via an oil passage 101 formed in the head cover 100 and an oil passageway 40*a* formed in the tappet guide 40, preventing seizure between the tappet guide 40 and the tappet 41 due to the reciprocal movement of the tappet 41. During upward and downward movement of the tappet 41, air can pass into a space defined by the cylinder 11, tappet guide 40, and tappet 41 via an air passage 102 formed in the head cover 100. Although the tappet 41 does not engage with a pin 61 even when the plunger 43 is in its bottom dead center position shown in FIG. 1, when the tappet 41 is attached to the head cover 100, the tappet 41 is prevented from falling off by this pin.

The plunger 43 is slidably supported along an axis by the inner wall surface of the cylinder 11 which composes a slide hole 11*a*. A spring seat 44 is urged by the compression coil spring 45 in the (–) Z-axial direction of FIG. 1 and abuts against an inner bottom surface of the tappet 41. A head portion 43*a* of the plunger 43 is clamped between an inner bottom surface of the tappet 41 and the spring seat 44 and is urged by the spring seat 44 in the (–) Z-axial direction of FIG. 1. The fuel pressurization chamber 16 is defined by an end face of the plunger 43 as viewed in the (+) Z-axial direction of FIG. 1, the inner wall surface of the cylinder 11, and the end face of the solenoid valve 20.

The operation of the high pressure fuel supply pump 10 will now be explained with reference to FIGS. 1 and 4A through 4C by being divided into (1) a fuel suction stroke and (2) a fuel pressurized force-feed stroke.

Figure 4A:
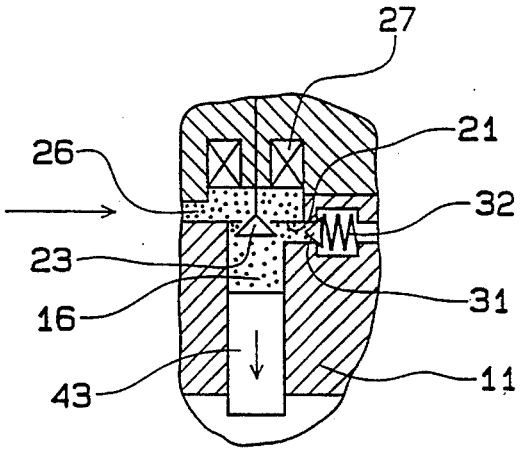
FIGS. 4A through 4C are schematic views illustrating the fuel intake and fuel-pressurization/force-feed strokes according to the first embodiment.

(1) Fuel Intake Stroke:

As the valve camshaft rotates, the pump cam 111 is rotated. Subsequently, the plunger 43 moves reciprocally along with the tappet 41 and the spring seat 44. When the plunger 43 reaches a maximum position thereof as viewed in the (+) Z-axial direction, which is at the top dead center, supply of current to the solenoids 27 of the solenoid valve 20 which as shown in FIG. 4A is interrupted. Then, the valve element 23 is moved away from the valve seat 21 by the urging force of a compression coil spring, not shown, whereby the solenoid valve 20 is opened. At this time, by the movement of the plunger 43 in the (–) Z-axial direction, the low pressure fuel that has been discharged from the fuel pump is allowed to flow into the fuel pressurization chamber 16 via the intake passage 12*a*, fuel passageway 13, fuel gallery 14, and communication passageway 26. And when the plunger 43 reaches a maximum position thereof as viewed in the (–) Z-axial direction, which is the bottom dead center, the maximum amount of low pressure fuel flows into the fuel pressurization chamber 16.

Figure 4B:
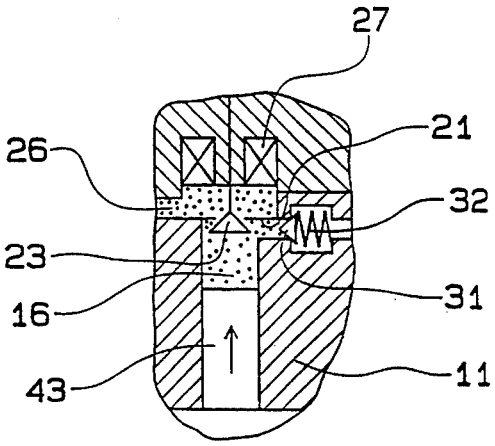
Figure 4C:
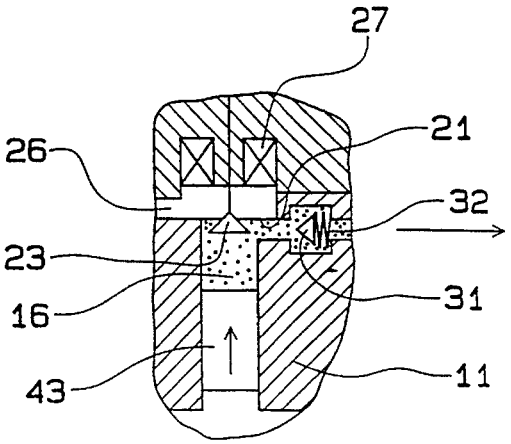

(2) Fuel Pressurized Force-Feed Stroke:

When as shown in FIG. 4B the plunger 43 reaches a position corresponding to a desired amount of fuel during the stroke in which the plunger 43 moves in the (+) Z-axial direction, an electric current is supplied to the solenoids 27 of the solenoid valve 20 through the operation of an electronic control unit. As a result, as shown in FIG. 4C, the valve element 23 abuts against the valve seat 21 due to movement in the (+) Z-axial direction. Namely, the solenoid valve is brought to an open state. Thereafter, when the plunger 43 is further moved in the (+) Z-axial direction, the pressure level of the fuel in the fuel pressurization chamber 16 increases, so that high pressure fuel is discharged from the delivery valve 30 to the common rail, not shown, via the discharge passageway 15, the space formed between the valve seat 33 and the discharge element 31, and the discharge port 34. At this time, in some cases, part of the high pressure fuel in the fuel pressurization chamber 16 flows into the sliding portion between the plunger 43 and the cylinder 11. The fuel that has thus flowed in is pooled in the fuel reservoir 11*b* shown in FIG. 1 and returned to the intake passage 12*a* through the return passageway 17. Since the fuel pressure, although low, is applied to the intake passage 12*a*, it often happens that the fuel pooled in the fuel reservoir 11*c* continues to flow in the (–) Z-axial direction. This fuel portion is pooled in the fuel reservoir 11*c*, passes through a return passageway 51 shown in FIG. 3, and eventually is returned from a return connector 52 to the fuel tank. Therefore, mixing of such fuel with the engine oil is completely prevented. The internal pressure of the return passageway 51 is equal to atmospheric pressure.

In this first embodiment, the high pressure fuel supply pump 10 is accommodated in the head cover 100, and, in addition, the common rail is usually disposed near the combustion chamber of the engine. Therefore, according to the first embodiment, it is possible to shorten the total length of the fuel steel pipes that connect the high pressure fuel supply pump 10, common rail, and combustion chamber to each other. For this reason, pulsation of the fuel discharged from the high pressure fuel supply pump 10 is previously damped to provide the advantage that stable injection of fuel can be maintained.

Second Embodiment

Figure 5:
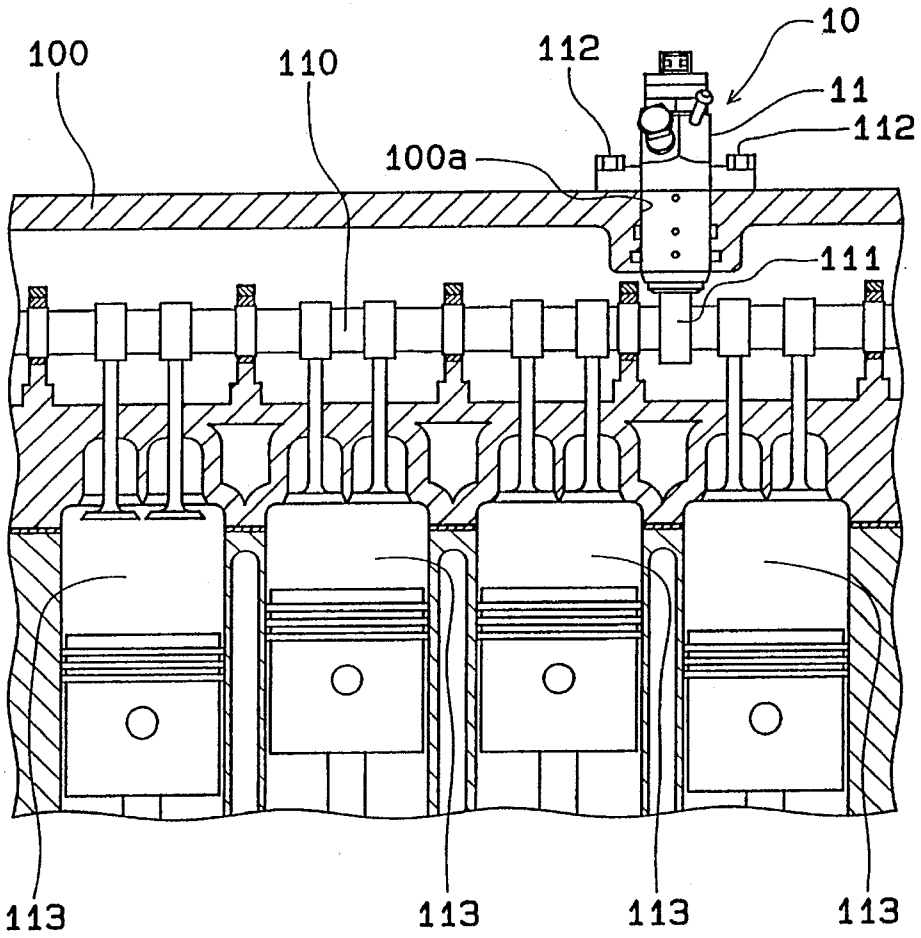
FIG. 5 is a sectional view showing a second embodiment wherein one high pressure fuel supply pump according to the first embodiment is mounted on the head cover.

FIG. 5 illustrates a second embodiment wherein one high pressure fuel supply pump according to the first embodiment is mounted on the head cover 100 of a multi-cylinder engine. The high pressure high supply pump 10 is fixed to the head cover 100 by means of bolts 112. The pump cam 111 attached to a valve camshaft 110 is provided with cam protrusions the number of which correspond to the number of air cylinders so as to enable the high pressure fuel to be supplied to the combustion chamber 113 of each air cylinder through the operation of a single high pressure fuel supply pump 10.

Third Embodiment

Figure 6:
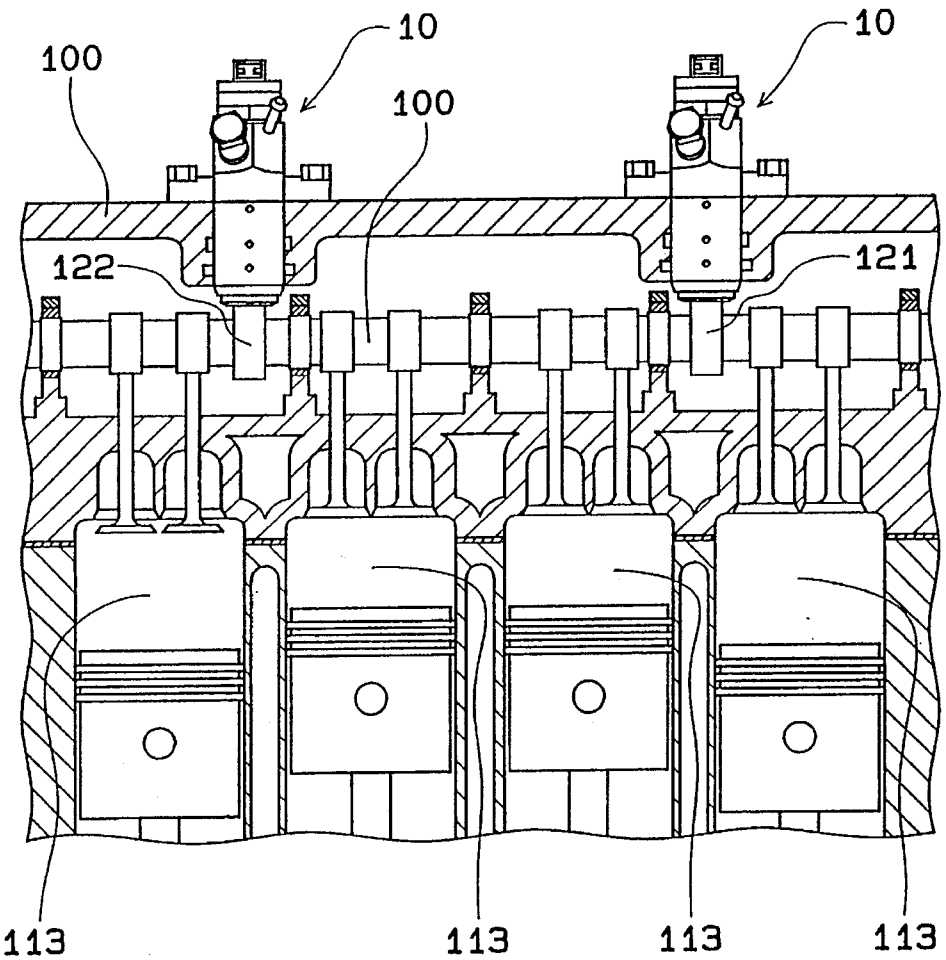
FIG. 6 is a sectional view showing a third embodiment wherein two high pressure fuel supply pumps according to the first embodiment are mounted on the head cover.

FIG. 6 shows a third embodiment wherein two high pressure fuel supply pumps 10 according to the first embodiment are mounted on the head cover 100 of a multi-cylinder engine. Since in an engine for a large-sized automotive vehicle the amount of fuel to be discharged must increase, two high pressure fuel supply pumps 10 are installed. The relevant air cylinders are shared by the two high pressure fuel supply pumps 10, each of which discharges fuel to its shared air cylinders.

According to the present invention, it is also possible for the high pressure fuel supply pump to independently operate for each air cylinder with the high pressure fuel supply pumps corresponding in number to the air cylinders being mounted on the head cover. In this case, each of the high pressure fuel supply pumps can be mounted in a given space with respect to the head cover and a pump cam can be mounted at the position of the valve camshaft corresponding to this mounting position, so that the degree of freedom of the position at which the high pressure fuel supply pump can be mounted is increased.

Fourth Embodiment

Figure 7:
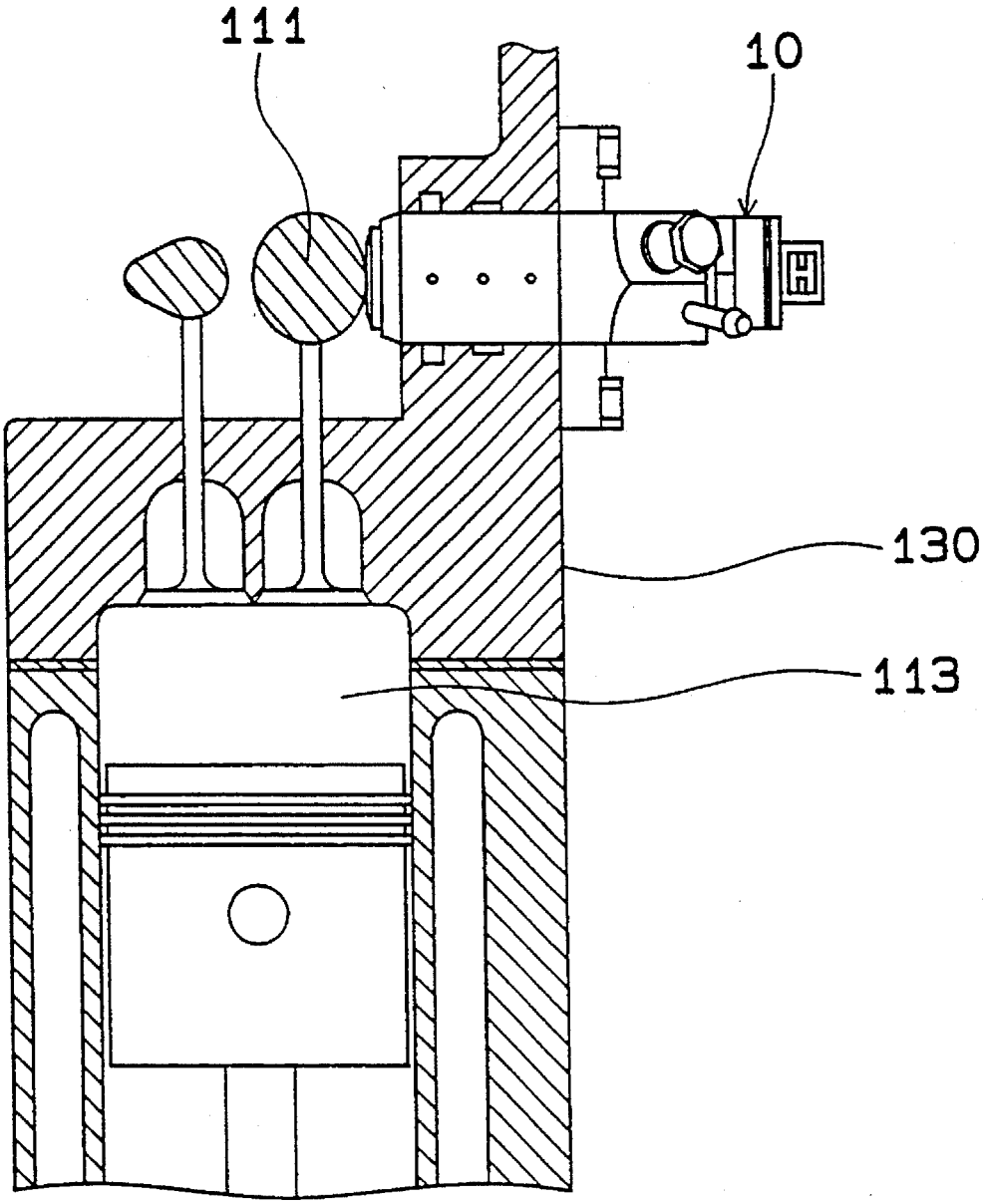
FIG. 7 is a sectional view showing a fourth embodiment wherein the high pressure fuel supply pump according to the first embodiment is mounted on the cylinder head.

FIG. 7 shows a fourth embodiment wherein the high pressure fuel supply pump 10 according to the first embodiment of the present invention is mounted on a cylinder head 130 which composes the engine housing. By loading the high pressure fuel supply pump 10 on the cylinder head 130 as well in this manner, the degree of freedom with which the mounting space of the high pressure fuel supply pump 10 can be utilized is further increased.

Fifth Embodiment

Figure 8:
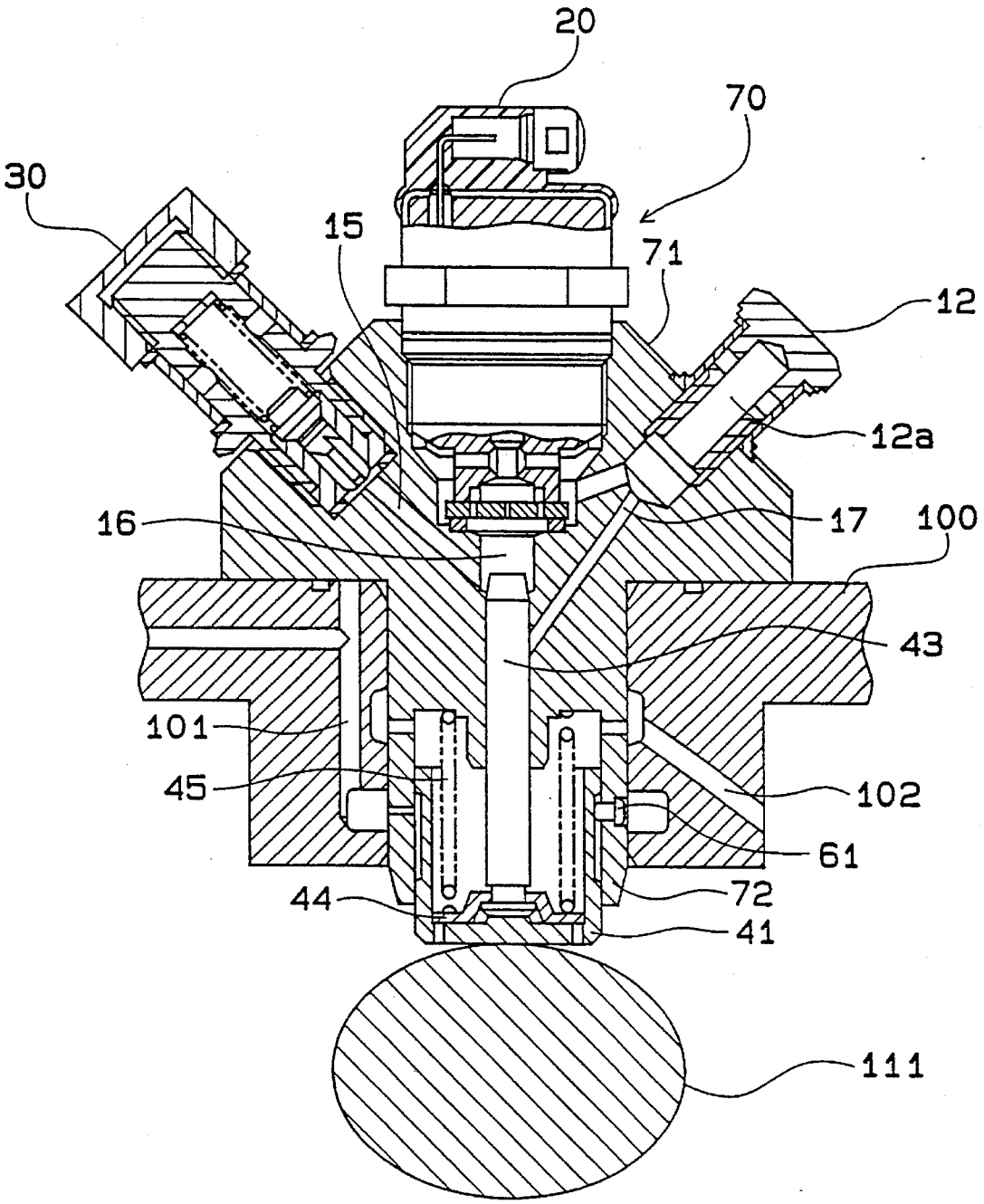
FIG. 8 is a sectional view showing a high pressure fuel supply pump according to a fifth embodiment of the present invention.

A high pressure fuel supply pump according to a fifth embodiment of the present invention is illustrated in FIG. 8.

In the fifth embodiment, since a tappet guide 72 is integrated with a cylinder 71 of a high pressure fuel supply pump 70 and it is not necessary for the tappet guide 72 to be attached to the cylinder 71, the axial or radial position of the tappet 41 can be prevented from deviating due to dimensional errors at the attached portion thereof. For this reason, the fuel intake/force-feed stroke of the plunger 43 that reciprocates along with the tappet 41 is carried out with high precision and in addition the number of the parts used in the high pressure fuel supply pump 70 is reduced.

Sixth Embodiment

Figure 9:
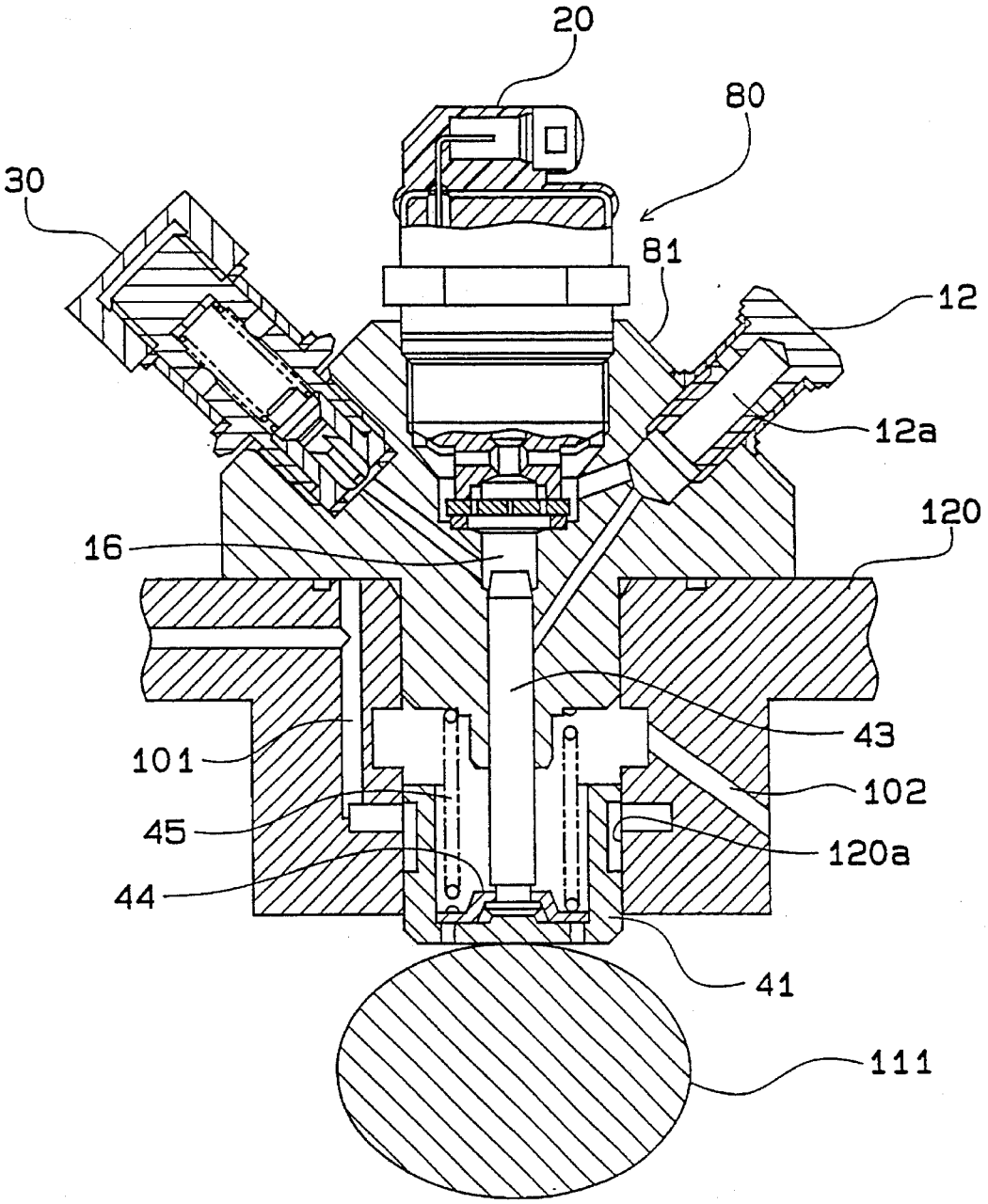
FIG. 9 is a sectional view showing a high pressure fuel supply pump according to a sixth embodiment of the present invention.

FIG. 9 illustrates a high pressure fuel supply pump according to a sixth embodiment of the present invention.

In this sixth embodiment, since the tappet 41 is guided directly by an inner wall surface 120*a* of a head cover 120 and thus renders unnecessary the formation of the tappet-guide fitting portion or the tappet guide per se in a cylinder 81, the advantage that fabrication of the cylinder 81 is simplified and the number of the parts used in the high pressure fuel supply pump 80 is reduced is obtained. Also, by reducing the number of the parts used, assembly errors resulting from dimensional errors at the attached portions can be decreased.

Seventh Embodiment

Figure 10:
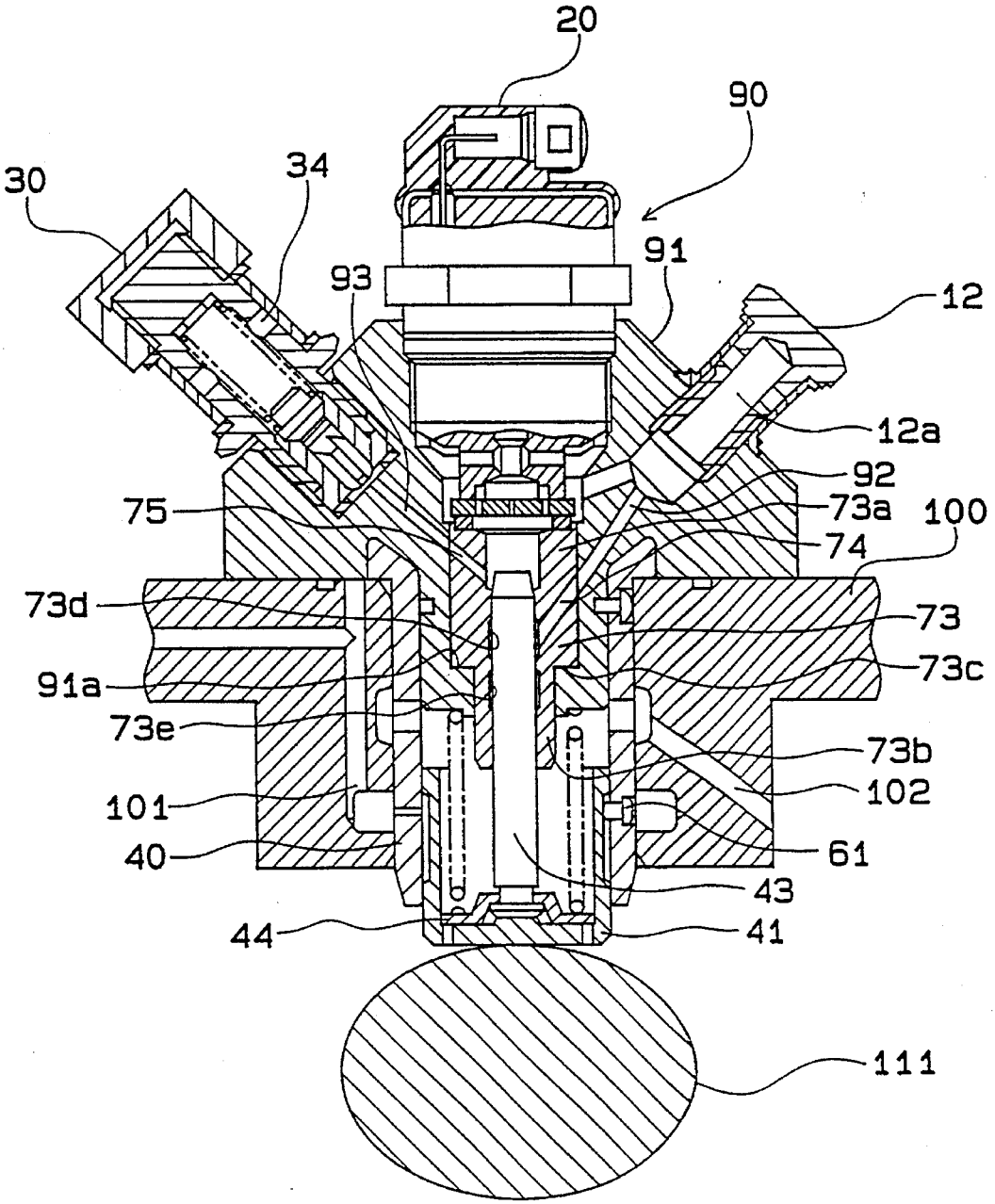
FIG. 10 is a sectional view showing a high pressure fuel supply pump according to a seventh embodiment of the present invention.

FIG. 10 illustrates a high pressure fuel supply pump according to a seventh embodiment of the present invention.

A cylindrical supporting member 73 of a high pressure fuel supply pump 80 is composed of a large-diameter portion 73*a* and a small-diameter portion 73*b* and this supporting member 73 slidably supports the plunger 43 in the axial direction thereof. A level difference portion 73*c* provided between the large-diameter portion 73*a* and the small-diameter portion 73*b* is retained by a retention portion 91*a* of a cylinder 91 and the supporting member 73 is fixed to the cylinder 91. A return passageway 74 communicates with an annularly formed fuel reservoir 73*d* and further communicates with the intake passage 12*a* via a return passageway 92. Further, a fuel passage 75 communicates with the discharge port 34 via a discharge passageway 93. An annularly formed fuel reservoir 73*e* communicates with a return passageway, not shown, whereby the fuel therein is eventually returned to the fuel tank from a return connector, also not shown, which is connected to the return passage. The supporting member 73 for supporting the plunger 43 is composed of a member separate from that of the cylinder 91, whereby the clearance between the plunger 43 and the supporting member 73 can be easily controlled.

Eighth Embodiment

Figure 11:
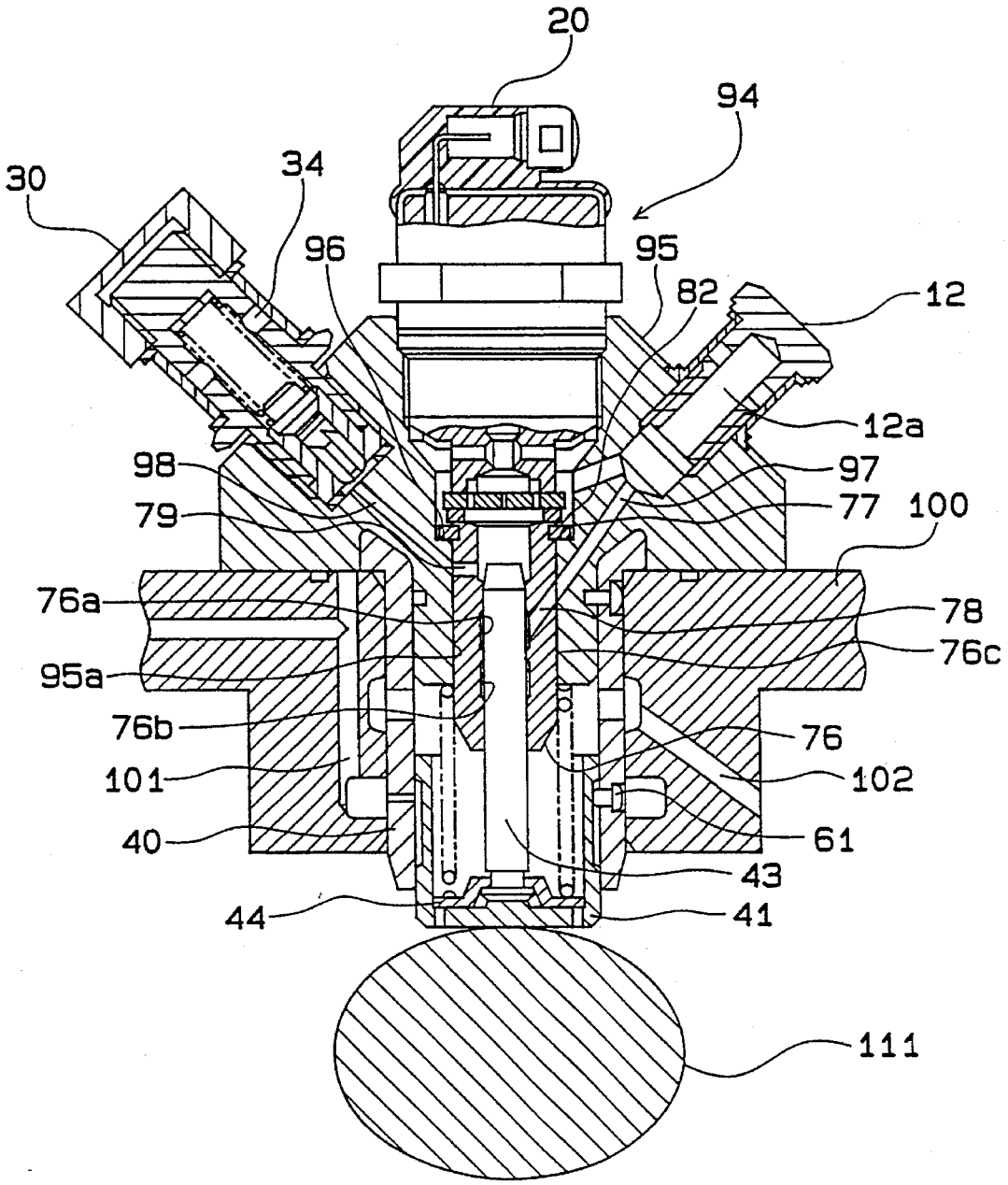
FIG. 11 is a sectional view showing a high pressure fuel supply pump according to an eighth embodiment of the present invention.

FIG. 11 illustrates a high pressure fuel supply pump according to an eighth embodiment of the present invention.

A cylindrical supporting member 76 of a high pressure fuel supply pump 94 slidably supports the plunger 43 in the axial direction thereof. The outer peripheral surface of an upper portion of the supporting member 76 is formed with an annular groove 77 into which a C-shaped positioning member 82 is fitted. Since the axial length of the groove 77 is somewhat longer than the thickness of the positioning member 82, the axial position of the positioning member 82 is controllable within the groove 77. Since the outside diameter of the positioning member 82 is larger than the diameter of the supporting member 76, the outer peripheral edge portion of the positioning member 82 is retained on a retention portion 96 provided on the inner wall surface of the cylinder 95. A return passageway 78 provided in the supporting member 76 communicates with an annularly formed fuel reservoir 76*a* and simultaneously communicates with the intake passage 12*a* via a return passageway 97 while, on the other hand, a fuel passage 79 communicates with the discharge port 34 via a discharge passageway 98. An annularly formed fuel reservoir 76*b* communicates with a return passageway, not shown, whereby the fuel therein is eventually returned to the fuel tank from a return connector, also not shown, that is connected to the return passageway.

The supporting member 76 is attached to the cylinder 95 in the following manner. (1) The positioning member 82 is fitted into the groove 77 of the supporting member 76. Then, (2) the cylinder 95 is heated and the supporting member 76 is inserted into the cylinder 95 up to a position at which the positioning member 82 is retained on the retention portion 96 of the cylinder 95, whereupon an outer wall surface 76*c* of the supporting member 76 and an inner wall surface 95*a* of the cylinder 95 are shrink-fitted together and fixed to each other. The retention position of the supporting member 76 can be controlled by axial movement of the positioning member 82 within the groove 77.

In the eighth embodiment, the supporting member 76 for supporting the plunger 43 is composed of a member that is separate from the member from which the cylinder is formed, whereby the clearance between the plunger 43 and the supporting member 73 can be easily controlled. Further, since the axial position of the positioning member 82 within the groove 77 is controllable, the retention portion 96 is not required to have high axial fabrication precision and therefore fabrication of the cylinder 95 becomes easy. Furthermore, no large-diameter and small-diameter portions are provided with respect to the supporting member 76, unlike the case of the seventh embodiment, but the supporting member 76 can be fabricated to a fixed outside diameter value, so that fabrication thereof becomes easy. Thus, reduction in the fabrication cost becomes possible.

Ninth Embodiment

Figure 12:
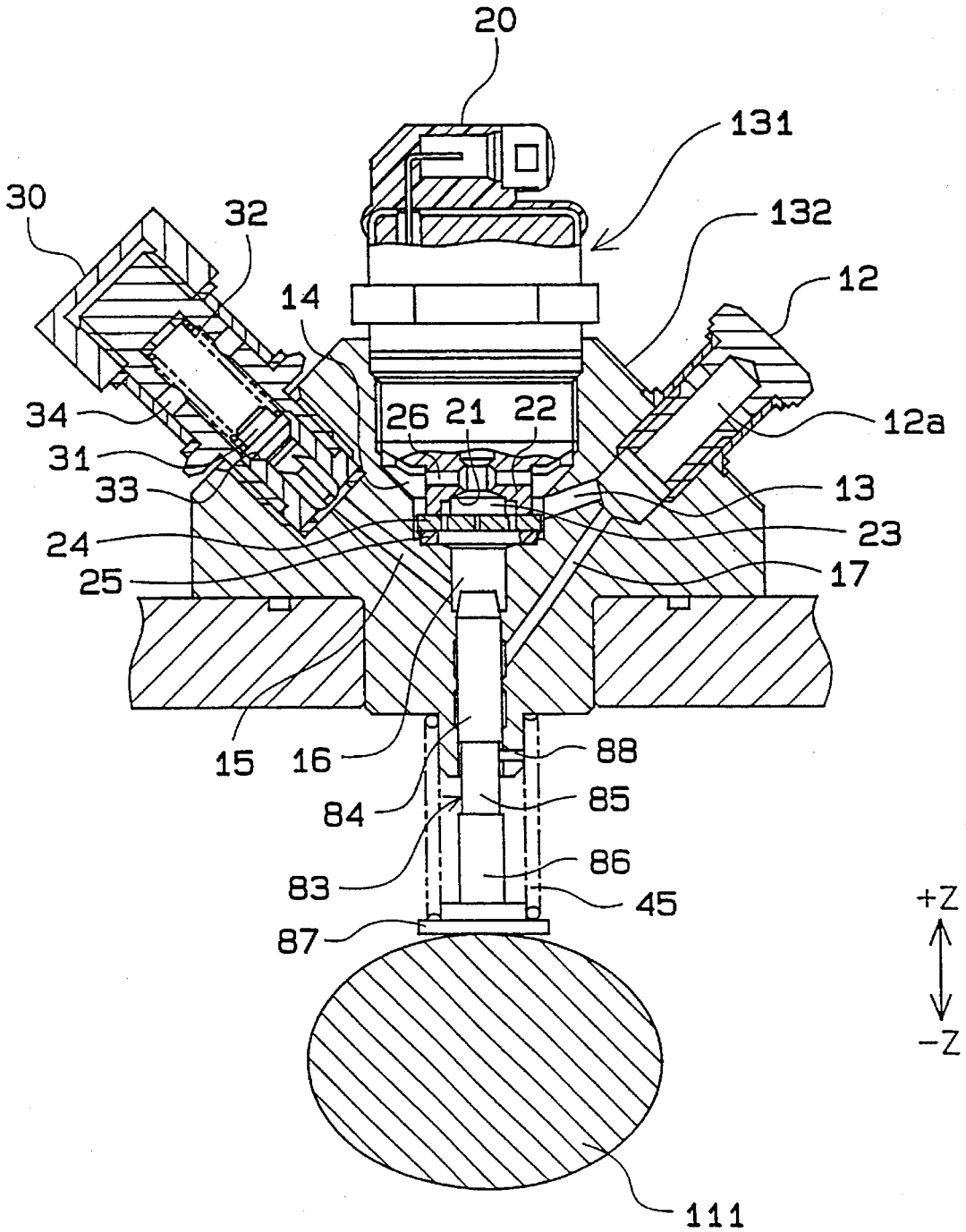
FIG. 12 is a sectional view taken along the line XII—XII of FIG. 13, illustrating a high pressure fuel supply pump according to a ninth embodiment of the present invention.
Figure 13:
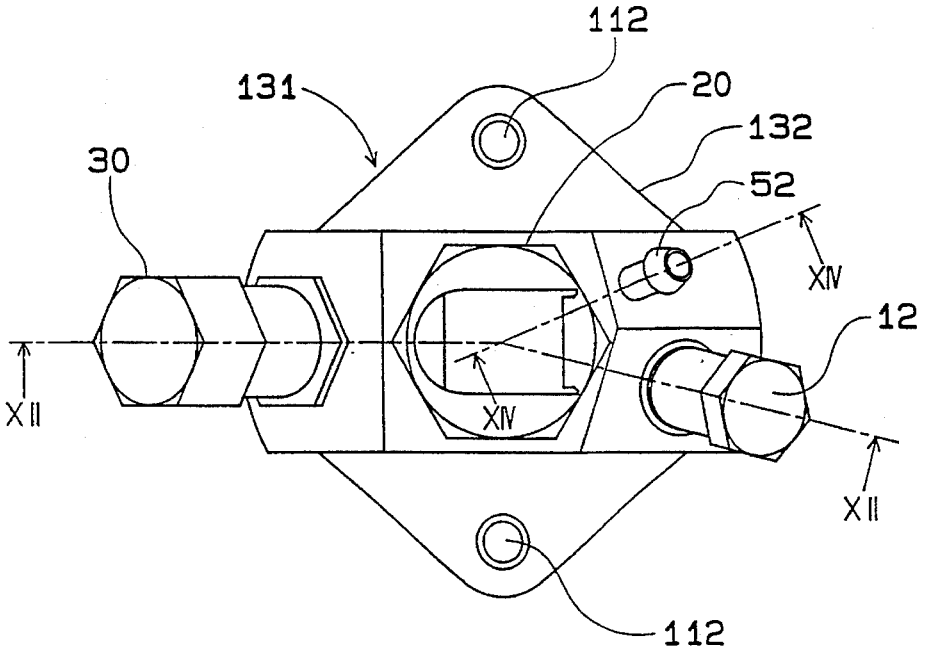
FIG. 13 is a plan view showing the high pressure fuel supply pump according to the ninth embodiment of the present invention.
Figure 14:
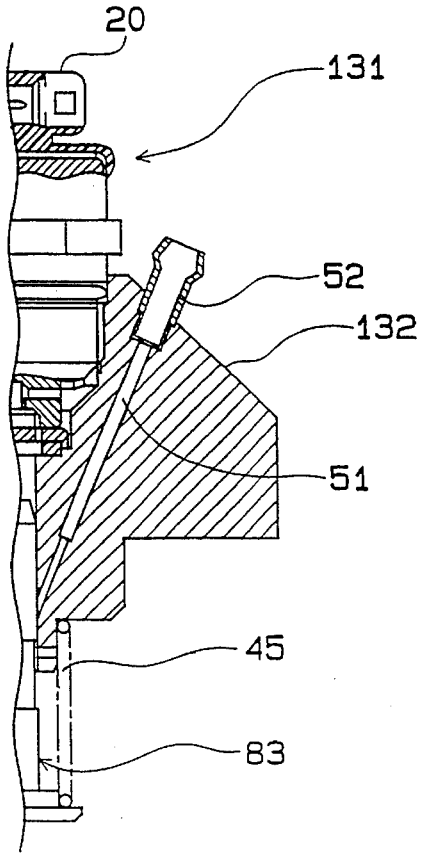
FIG. 14 is a sectional view taken along the line XIV—XIV of FIG. 13.

FIGS. 12 through 14 illustrate a high pressure fuel supply pump according to a ninth embodiment of the present invention.

A plunger 83 is integrally formed with a first large-diameter portion 84, small-diameter portion 85, second large-diameter portion 86, and plunger head 87 in that order from the side of the fuel pressurization chamber 16, and an end face of the plunger head 87 abuts against the pump cam 111. A compression coil spring 45 abuts, at one end, against an outer wall surface of a cylinder 132 and abuts, at the other end, against a plunger head 87, thereby urging the plunger 83 in the (–) Z-axial direction. A pin 88 is inserted into a side wall surface of the cylinder 132 portion that supports the plunger 83. The pin 88 can retain a level difference portion provided between the first large-diameter portion 84 and the small-diameter portion 85 of the plunger 83, whereby when assembling the high pressure fuel supply pump 131 the pin serves to prevent the plunger 83 from falling off.

In the present invention, a removably attachable screw can also be used in place of the pin 88.

Tenth Embodiment

Figure 15:
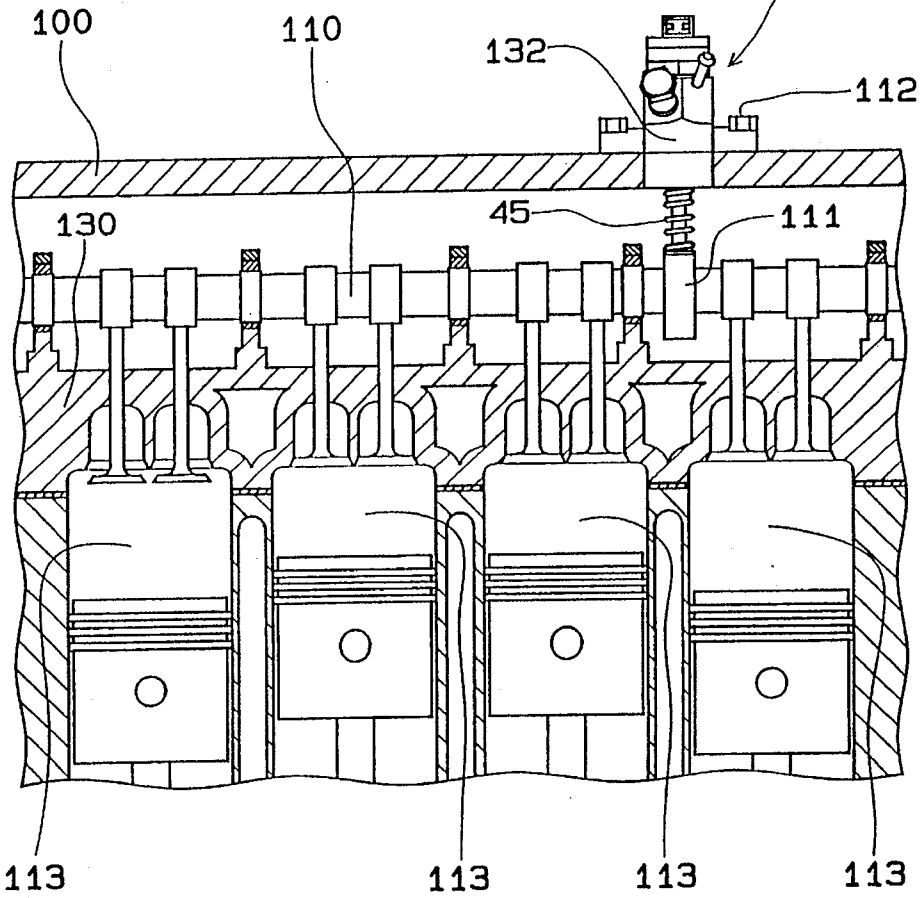
FIG. 15 is a sectional view showing a tenth embodiment wherein one high pressure fuel supply pump according to the ninth embodiment is mounted on the head cover.

A tenth embodiment wherein one high pressure fuel supply pump 131 according to the ninth embodiment is mounted on the head cover 100 of a multi-cylinder engine is illustrated in FIG. 15. The high pressure fuel supply pump 131 is fixed to the head cover 100 by means of bolts 112. The pump cam 111 is provided with cam protrusions the number of which correspond to the number of air cylinders, whereby high pressure fuel is supplied to the combustion chamber of each air cylinder.

In the present invention, it is possible for a plurality of high pressure fuel supply pumps 131 to be mounted on the head cover 100 of a multi-cylinder engine. Further, it is also possible for a plurality of high pressure fuel supply pumps 131 to be mounted on the cylinder head 130 of a multi-cylinder engine.

Eleventh Embodiment

Figure 16:
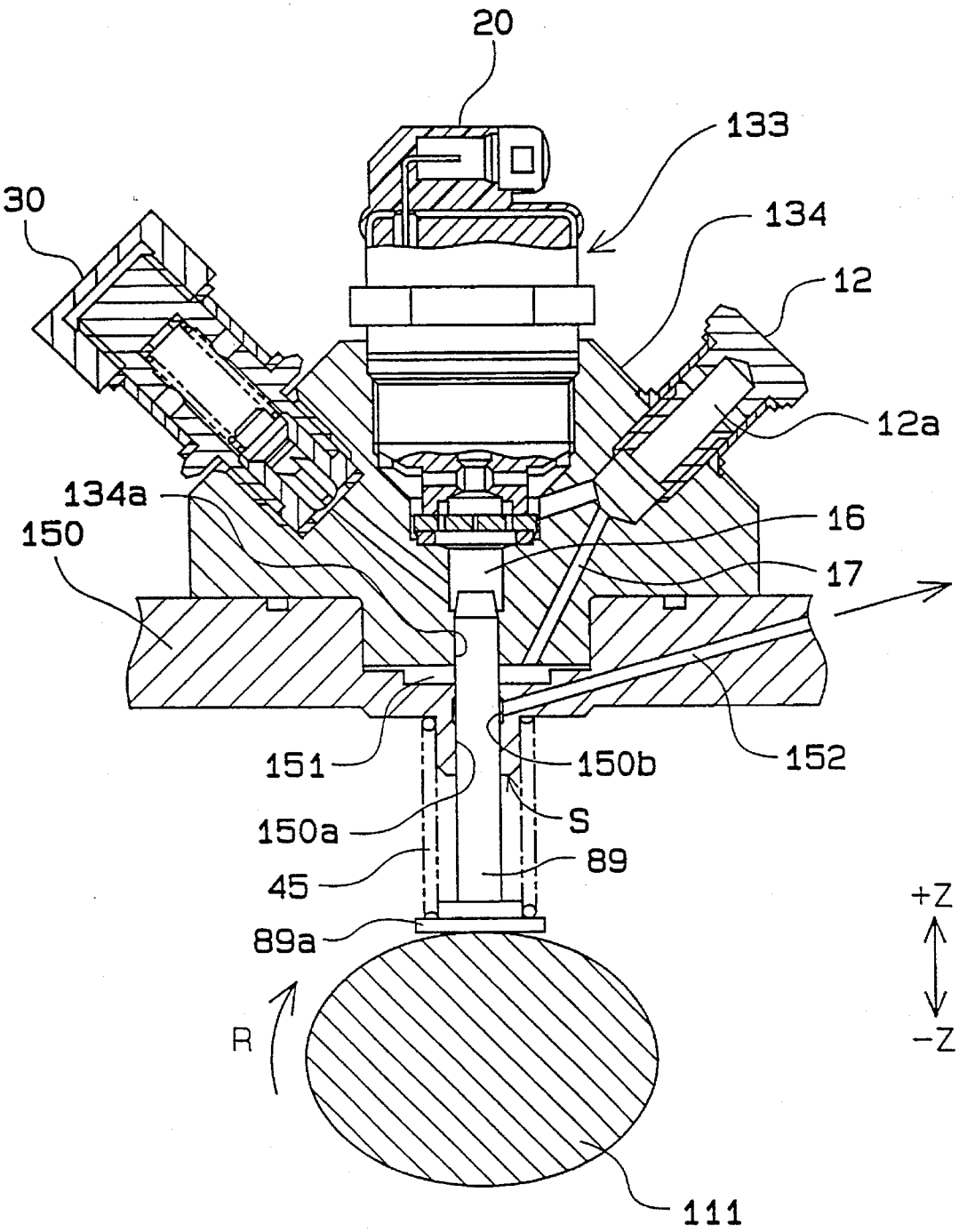
FIG. 16 is a sectional view showing a high pressure fuel supply pump according to an eleventh embodiment of the present invention.

A high pressure fuel supply pump according to an eleventh embodiment of the present invention is illustrated in FIG. 16.

A plunger 89 is supported by an inner wall surface 134*a* of a cylinder 134 and an inner wall surface 150*a* of a head cover 150 so that the plunger may be reciprocally movable and slidable. An end face of a plunger head 89*a* abuts against the pump cam 111. An annular flat plate-like return chamber 151 is formed around the plunger 89 at the border between a cylinder 134 and the head cover 150. The return chamber 151 communicates with the intake passage 12*a* via the return passageway 17. One head cover 150 is formed with an annular fuel reservoir 150*b* which, in turn, communicates with a return passageway 152.

The high pressure fuel in the fuel pressurization chamber 16 that has flowed into the slide portion between the cylinder 134 and the plunger 89 is pooled in the return chamber 151 and then returned from this return chamber to the intake passage 12*a* via the return passageway 17. Further, the fuel that has flowed from the return chamber 151 into the slide portion between the head cover 150 and the plunger 89 is pooled in a fuel reservoir 150*b* and then returned to the fuel tank via the return passageway 152.

In the eleventh embodiment, the return passageway 17 communicates with the annular flat plate-like return chamber 151 so that the range of communicability therebetween is wide. For this reason, fabrication errors with respect to the return passageway 17 are permitted within the range in which the return passageway 17 can communicate with the return chamber 151. Further, since one fuel reservoir 150*b* formed in the head cover 150 suffices, the number of fabrication steps of the head cover 150 is reduced.

In the high pressure fuel supply pump 133 of the eleventh embodiment illustrated in FIG. 16, the plunger 89 is located at a position corresponding to the bottom dead center and, as the pump cam 11 rotates in the R-indicated direction, tends to move upward in the (+) Z-axial direction. At this time, since the plunger 89 receives radial force, it often happens that a large frictional force acts on the slide portion between the plunger 89 and the head cover 150 which is indicated by the arrow S in FIG. 16. In some cases, therefore, the problem arises that defective sliding of the plunger 89 occurs, or that the plunger 89 or head cover 150 incurs wear. A twelfth embodiment which will be explained next has been prepared for the purpose of solving this problem.

Twelfth Embodiment

Figure 17:
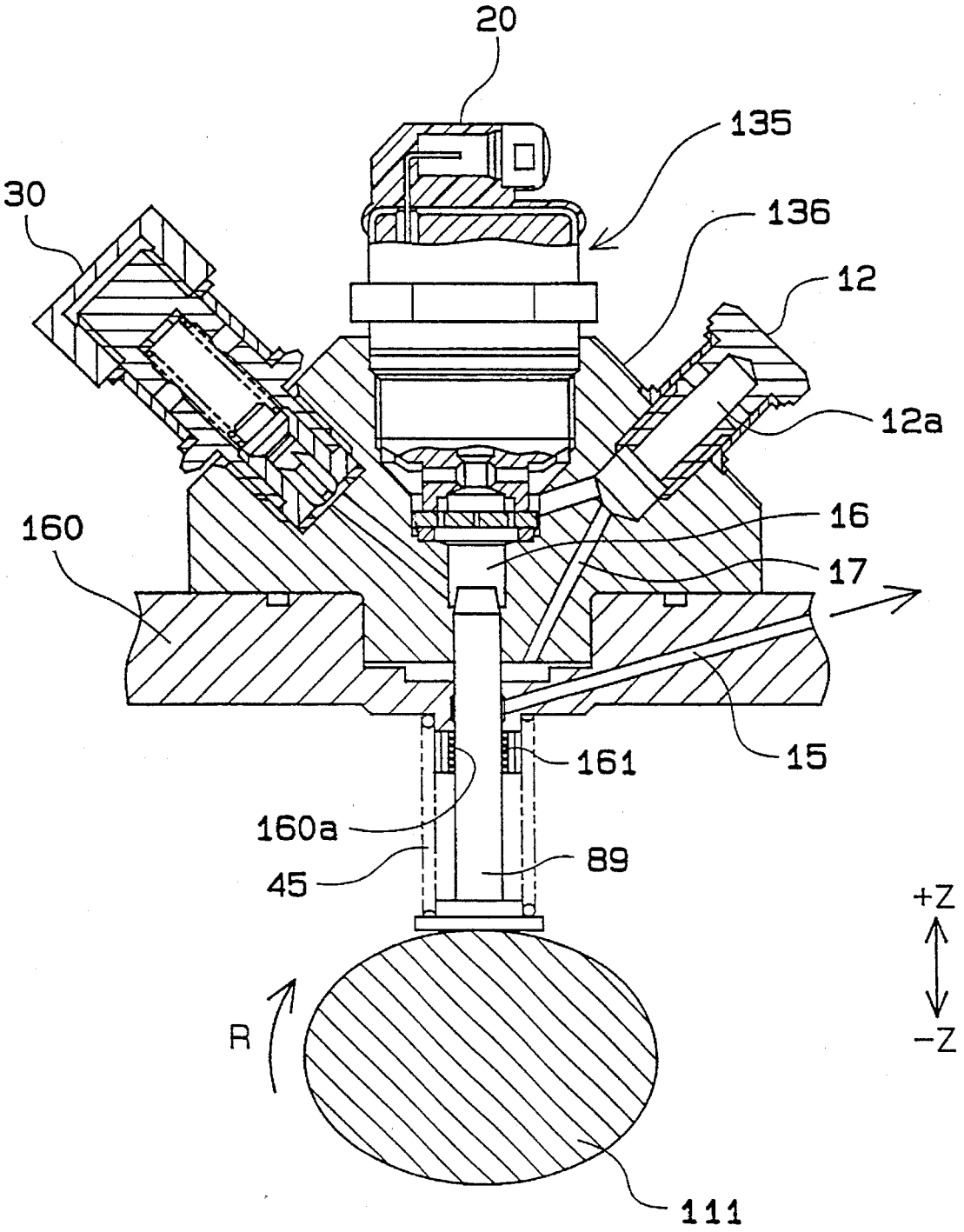
FIG. 17 is a sectional view showing a high pressure fuel supply pump according to a twelfth embodiment of the present invention.

A high pressure fuel supply pump 135 according to a twelfth embodiment of the present invention illustrated in FIG. 17 has been devised in order to solve the problem of the eleventh embodiment.

A cylindrical space portion 160*a* is provided in the inner wall surface of an end portion of the head cover 160 located on the side of the pump cam 111. The plunger 89 is supported not only by the inner wall surface of the cylinder 136 but also by balls 16*a* which fill the space portion 160*a* so that the plunger 89 can perform reciprocal movement. As a result, even when a radial force works on the plunger 89 as the pump cam 111 rotates, the upward movement of the plunger 89 in the (+) Z-axial direction is smoothly performed, whereby the frictional force acting on the slide portion between the plunger 89 and the head cover 160 is greatly decreased.

Thirteenth Embodiment

Figure 18:
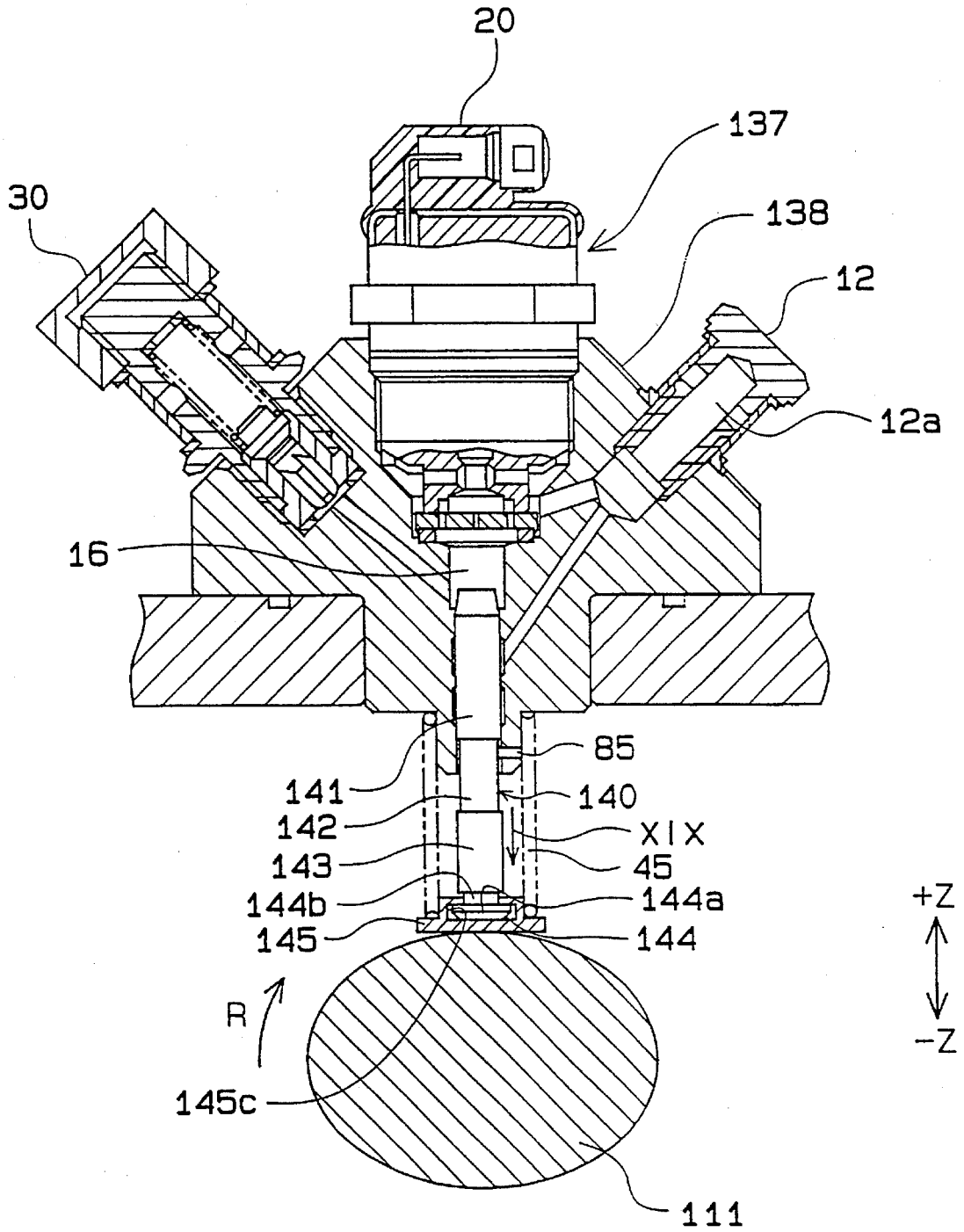
FIG. 18 is a sectional view showing a high pressure fuel supply pump according to a thirteenth embodiment of the present invention.
Figure 19:
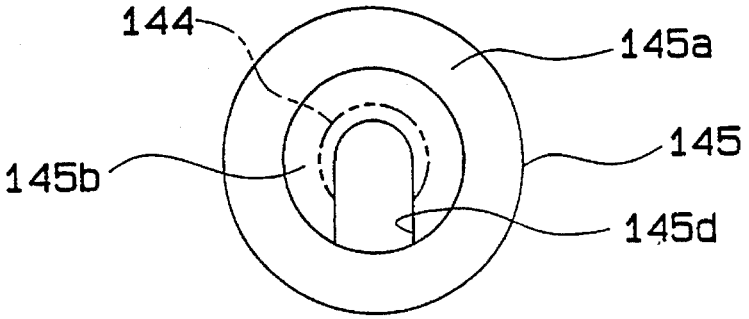
FIG. 19 is a view taken from the direction indicated by the arrow XIX of FIG. 18.
Figure 20:
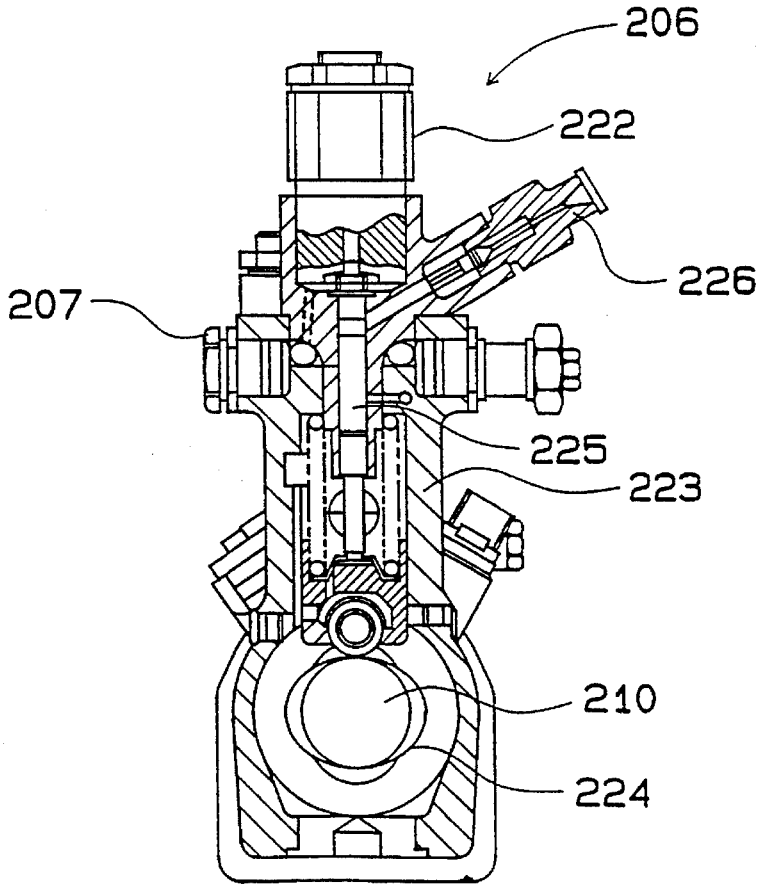
FIG. 20 PRIOR ART
FIG. 20 is a sectional view showing a conventional high pressure fuel supply pump and taken along the line XX—XX of FIG. 21.
Figure 21:
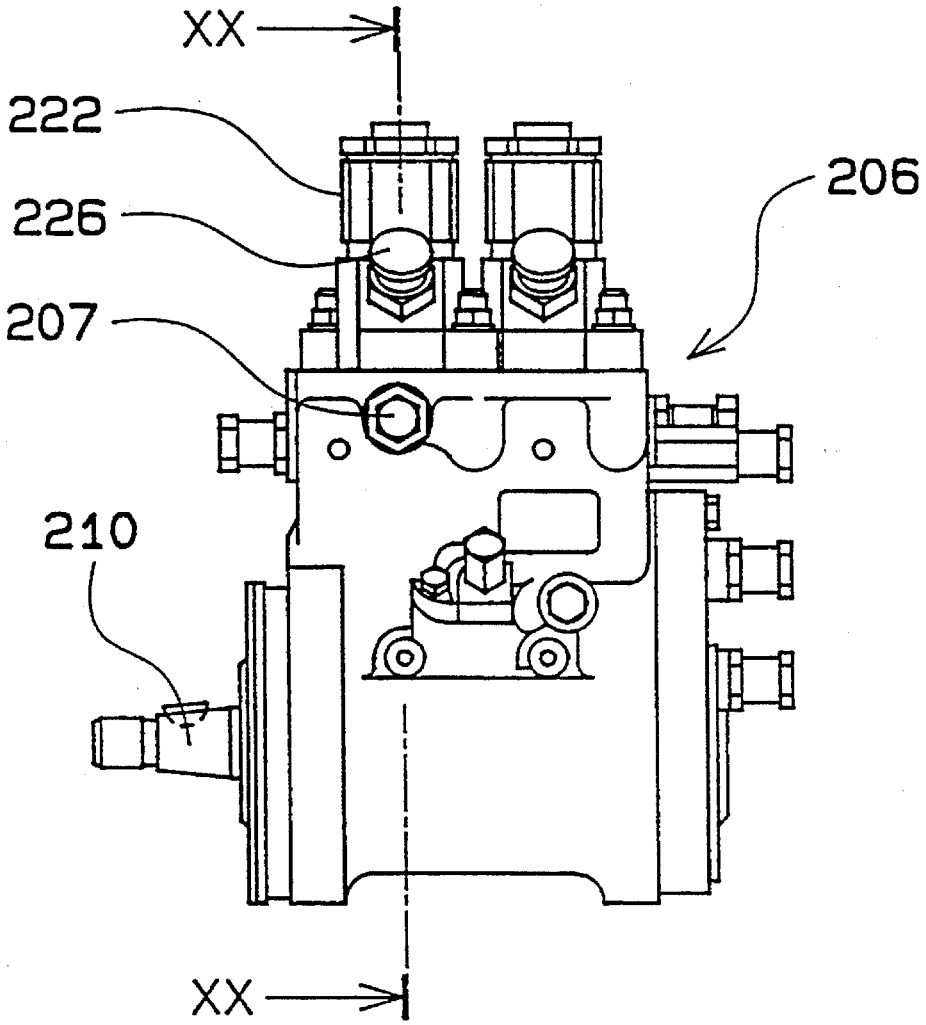
FIG. 21 PRIOR ART
FIG. 21 is a partial side view showing the conventional high pressure fuel supply pump.

A high pressure fuel supply pump according to a thirteenth embodiment of the present invention is illustrated in FIGS. 18 and 19.

A plunger 140 is integrally formed with a first large-diameter portion 141, small-diameter portion 142, second large-diameter portion 143, and plunger head 144 in that order from the side of the fuel pressurization chamber 16. The plunger head 144 is composed of a head portion 144*a* and a shaft portion 144*b*. The plunger head 144 is fitted into a spring seat 145 having elasticity, the end face of which abuts the pump cam 111.

The spring seat 145 is composed of a disk-shaped abutment portion 145*a* that abuts the pump cam 111 and a fitting portion 145*b* into which the plunger head 144 is fitted. The fitting portion 145*b* is formed with a space portion 145*c* in which the plunger head 144 can be received, and with a notch 145*d* in which the shaft portion 144*b* can be inserted.

When the plunger 140 is moved upward in the (+) Z-axial direction from the bottom dead center position of the plunger 140 by the rotation of the pump cam 111, a radial force acts on the spring seat 145. Since this radial force is absorbed by the elasticity of the spring seat 145, the frictional force which acts on the slide portion between the cylinder 138 of the high pressure fuel supply pump 137 and the plunger 140 is reduced.

Figure 22:
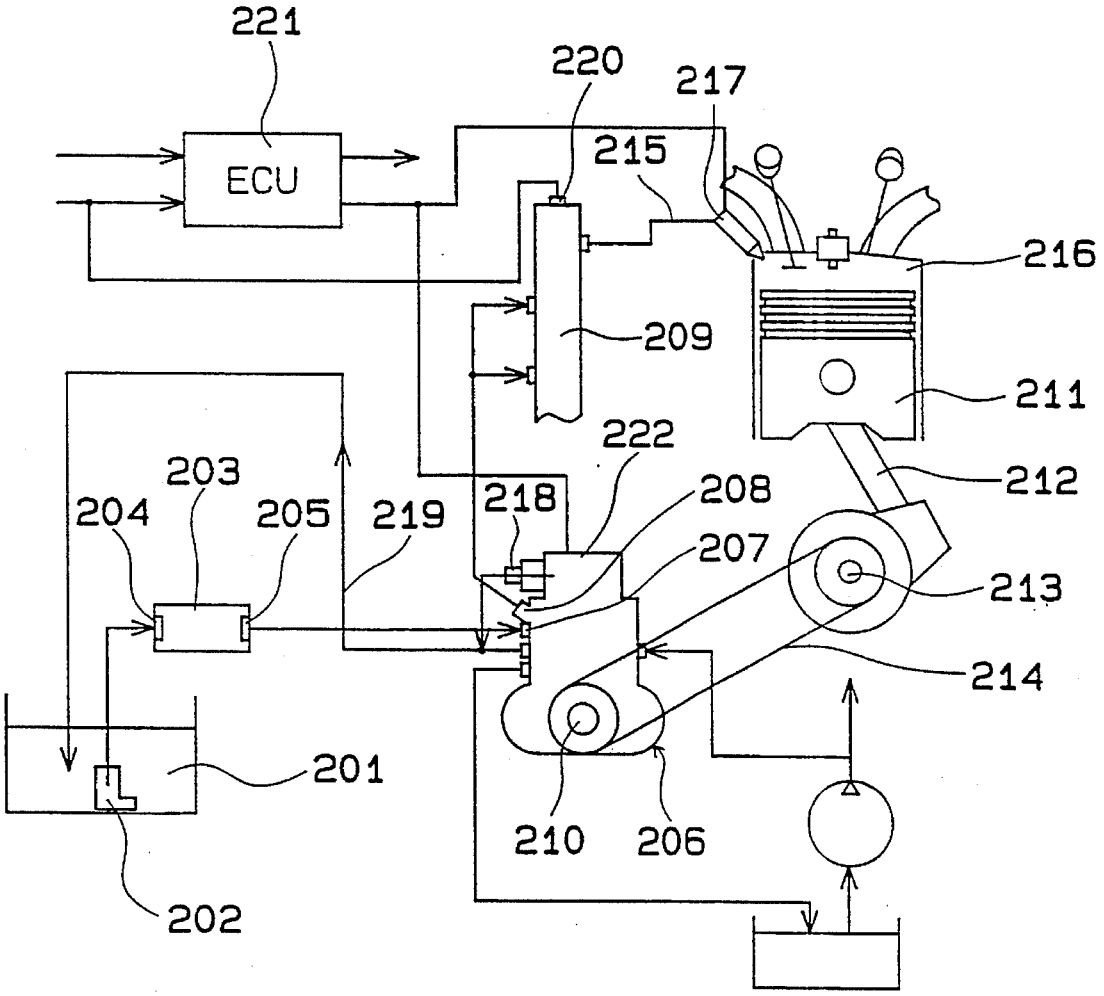
FIG. 22 PRIOR ART
FIG. 22 is a schematic illustration showing a fuel supply system using a conventional high pressure supply pump.
Figure 23:
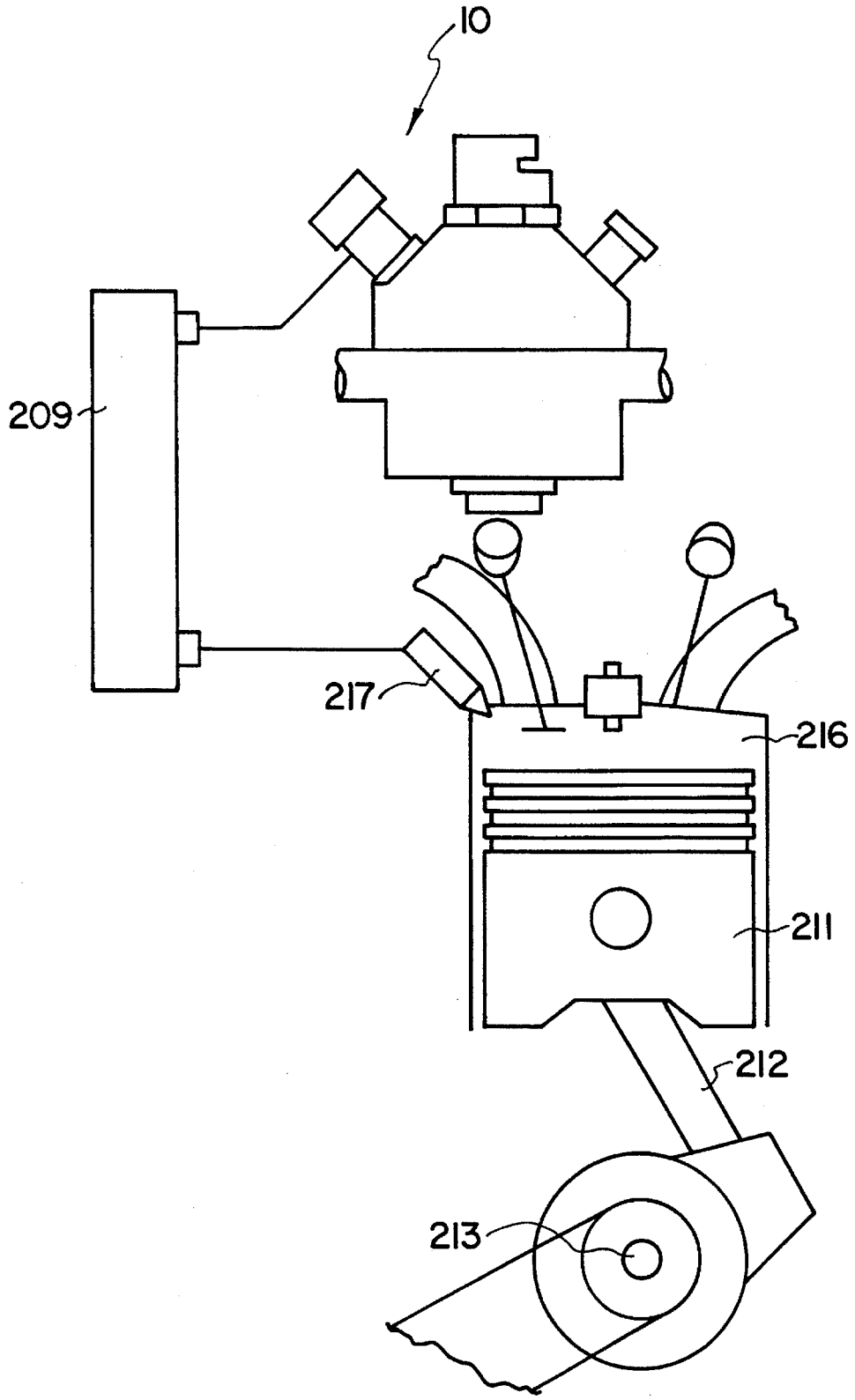
FIG. 23 is a schematic illustration showing a fuel supply system using the high pressure fuel supply pump of FIG. 1.

FIG. 23 is a schematic illustration of a fuel supply system, similar to that of FIG. 22, but which employs the high pressure fuel supply pump 10 of the invention. In FIGS. 22 and 23, like parts are given like numerals.

Although in the above-explained embodiments of the present invention reference has been made to a case where one or more high pressure fuel supply pumps according to a specific one of the embodiments is/are mounted on the housing of an engine, in the present invention one or more high pressure fuel supply pumps according to any one of the embodiments thereof can be mounted on the housing of an engine.

What is claimed is:

1. An internal combustion engine with a high pressure fuel supply pump, said engine comprising:

a housing of said engine, said housing having an accommodation hole; and an injector disposed on said housing for feeding fuel into a combustion chamber;

said engine having a camshaft; and a common rail for feeding high pressure fuel to said injector; said common rail located adjacent to said injector; said fuel pump being disposed in said accommodation hole and comprising a plunger movable reciprocally;

a first supporting member having an intake passage and a discharge passage for fuel, and having an inner wall forming a slide hole in which said plunger is reciprocally and slidably supported, said discharge passage communicating with said common rail and said fuel pump;

a pump cam for driving said plunger to enable reciprocal movement;

an urging means for urging said plunger to enable reciprocal movement;

a solenoid valve provided at one end of said slide hole for determining discharge timing of the fuel pressurized by the reciprocating movement of the said plunger, wherein said common rail is disposed to be adjacent to said fuel pump and said discharge passage for feeding the high pressure fuel to said injector so that the length of said discharge passage is shortened and pulsation of the high pressure fuel discharged from said fuel pump is previously damped.

2. An internal combustion engine with a high pressure fuel supply pump as set forth in claim 1, wherein said camshaft of said internal combustion engine is a valve camshaft of said internal combustion engine.

3. An internal combustion engine as set forth in claim 2, further comprising a fuel pressurization chamber defined by an end face of said plunger, said inner wall of said first supporting member, and an end face of said solenoid valve, the fuel is introduced from said intake passage into said fuel pressurization chamber and pressurized by the reciprocating movement of said plunger.

4. An internal combustion engine as set forth in claim 3, wherein said housing is a cylinder head cover.

5. An internal combustion engine as set forth in claim 3, wherein said housing is a cylinder head.

6. An internal combustion engine as set forth in claim 3, further comprising:

a first drive force transmission member transmitting drive force of said pump cam to said plunger, said first drive force transmission member mounted to an end of said plunger on an opposite side to that of the fuel pressurization chamber, reciprocated integrally with said plunger, and disposed between said plunger and said pump cam; and a guide member for guiding said first drive force transmission member.

7. An internal combustion engine as set forth in claim 6, wherein said guide member is formed integrally with said first supporting member.

8. An internal combustion engine as set forth in claim 6, wherein said guide member is formed integrally with said housing.

9. An internal combustion engine as set forth in claim 3, wherein said first supporting member includes a second supporting member having said inner wall defining said slide hole, and a third supporting member fixing said second supporting member.

10. An internal combustion engine as set forth in claim 3, wherein said housing supports said plunger to reciprocate and slide.

11. An internal combustion engine as set forth in claim 10, wherein said inner wall of said housing supporting said plunger has a frictional-force damping means for reducing friction between said plunger and said housing.

12. An internal combustion engine as set forth in claim 3, wherein said inner wall of said first supporting member has a frictional-force damping means for reducing friction between said plunger and said first supporting member.

13. An internal combustion engine as set forth in claim 3, further comprising:

a second drive force transmission member transmitting drive force of said pump cam to said plunger, said first drive force transmission member mounted to an end of said plunger on an opposite side to that of the fuel pressurization chamber, reciprocated integrally with said plunger, and disposed between said plunger and said pump cam.

14. An internal combustion engine as set forth in claim 13, wherein said second drive force transmission member has an elasticity in a radial direction.

15. A method for mounting high pressure fuel supply pumps, comprising the step of:

providing a plurality of said high pressure fuel supply pumps, each fuel supply pump being constructed and arranged to be connected to a camshaft of an internal combustion engine having a housing at which an accommodation hole is formed, said internal combustion engine having a common rail for feeding high pressure fuel to an injector between a fuel supply pump and said injector, each said fuel supply pump being disposed in an associated said accommodation hole and including a plunger moving reciprocally; a first supporting member having an intake passage and a discharge passage for fuel, and having an inner wall forming a slide hole in which said plunger is reciprocally and slidably supported; a pump cam driving said plunger to enable reciprocal movement; an urging means for urging said plunger toward the side of said pump cam; and a solenoid valve provided at one end of said slide hole for determining discharge timing of the fuel pressurized by the reciprocating movement of said plunger, wherein said common rail is disposed to be adjacent to each said fuel supply pump and said discharge passage communicates with said common rail for feeding the high pressure fuel to injectors so that pulsation of the high pressure fuel discharged from each said fuel supply pump is previously damped;

fixing the plurality of said high pressure fuel supply pumps to said housing adjacent to said common rail;

setting said pump cam for driving said plunger on said camshaft at each corresponding place of each said high pressure fuel supply pump.

16. A method for mounting a high pressure fuel supply pump as set forth in claim 15, wherein said camshaft of said internal combustion engine is a valve camshaft of said internal combustion engine.

* * * * *